US010385580B2

(12) United States Patent
Foley

(10) Patent No.: US 10,385,580 B2
(45) Date of Patent: Aug. 20, 2019

(54) POOL COPING SYSTEM

(71) Applicant: Trent Foley, Carramar (AU)

(72) Inventor: Trent Foley, Carramar (AU)

( * ) Notice: Subject to any disclaimer, the term of this patent is extended or adjusted under 35 U.S.C. 154(b) by 0 days.

(21) Appl. No.: 15/761,076

(22) PCT Filed: Sep. 16, 2016

(86) PCT No.: PCT/AU2016/000325
§ 371 (c)(1),
(2) Date: Mar. 16, 2018

(87) PCT Pub. No.: WO2017/046016
PCT Pub. Date: Mar. 23, 2017

(65) Prior Publication Data

US 2018/0266132 A1 Sep. 20, 2018

(30) Foreign Application Priority Data

Sep. 17, 2015 (AU) ..... 2015903791

(51) Int. Cl.
*E04H 4/14* (2006.01)
*E04G 17/14* (2006.01)

(52) U.S. Cl.
CPC ..... *E04H 4/141* (2013.01); *E04G 17/14* (2013.01)

(58) Field of Classification Search
CPC ..... E04H 4/141
USPC ..... 4/506
See application file for complete search history.

(56) References Cited

U.S. PATENT DOCUMENTS

| | | | |
|---|---|---|---|
| 4,625,343 | A | 12/1986 | Bumgarner, Sr. |
| 6,260,313 | B1 | 7/2001 | Stegmeier |
| 8,960,636 | B1 | 2/2015 | Stegmeier, Jr. |
| 2005/0091738 | A1 | 5/2005 | Smith |

OTHER PUBLICATIONS

International Searching Authority, PCT International Search Report, dated Oct. 27, 2016, pp. 1-5, International Application No. PCT/AU2016/000325.

*Primary Examiner* — Lori L Baker
(74) *Attorney, Agent, or Firm* — Woodling, Krost and Rust

(57) ABSTRACT

The present invention relates to a bracket for creating continuous coping of a poured settable material over the edge of a structure, comprising: a spine with an upper portion for supporting a piece of formwork; and a means for temporarily mounting the bracket upon a surface. The means for temporarily mounting the bracket may comprise a suction cup. Also described is a method of creating continuous coping of a poured settable material over the edge of a structure, comprising the use of the bracket to support formwork creating a box into which the material is filled.

10 Claims, 2 Drawing Sheets

POOL COPING SYSTEM

PCT/AU2016/000325, international application filing date 16 Sep. 2016, and Australian provisional patent application no. 2015903791 filed 17 Sep. 2015 are incorporated herein by reference hereto in their entireties.

FIELD OF THE INVENTION

The present invention relates to a system for pool coping and device for use with the system.

BACKGROUND

Many commercial and residential properties in Australia and overseas include a swimming pool on the properly. An important part of living around a swimming pool includes landscaping. Traditional landscaping around a swimming pool requires the lip of the pool to be exposed, or coping to be applied to the lip in the form of pavers or tiles. Accordingly, the immediate pool edge is not continuous with respect to the remaining landscape.

Previous methods have been developed to obtain a continuous landscape surrounding a pool. A known method involves the use of polystyrene adhered to the pool for creating formwork into which concrete may be poured. The adhesive, however, is difficult to remove from the pool and the polystyrene can create a large, time-consuming mess to clean after installation. Additionally, polystyrene is fragile and can be broken or knocked out of place with very little effort. Furthermore, polystyrene is not particularly strong, resulting in a lack of size and style options. The lack of strength also creates a need for reinforcing ties to be used to achieve straightness when the weight of the concrete is applied, which is time-consuming and hence increases cost.

The present invention attempts to overcome at least in part the aforementioned disadvantages of previous pool coping systems.

SUMMARY OF THE INVENTION

In accordance with one aspect of the present invention there is provided a bracket for creating continuous coping of a poured settable material beyond the edge of a structure, comprising:

a spine with an upper portion for supporting a piece of form work; and a means for temporarily mounting the bracket upon a surface.

The means for temporarily mounting the bracket may comprise a suction cup.

The suction cup may comprise an operating mechanism for releasably creating a vacuum between the suction cup and another surface.

The spine may further comprise a lower portion upon which the means for temporarily mounting the bracket is disposed.

The bracket may further comprise a cushion at a lower terminal end of the spine for protecting a surface within which the spine comes into contact.

The upper portion of the spine may be configured as a substantial right angle within the spine.

The lower portion of the spine may be configured as an obtuse angle within the spine.

The spine may further comprise an aperture for allowing passage of a fixing means through the spine.

In accordance with a second aspect of the present invention there is provided a method of creating continuous coping of a poured sellable material beyond the edge of a structure, comprising the use of a bracket to support form work creating a box into which the material is filled, wherein said bracket comprises a means for temporarily mounting the bracket upon a surface.

The continuous coping may be created beyond the edge of a pool.

The continuous coping may be created beyond the edge of a curved structure.

BRIEF DESCRIPTION OF DRAWINGS

The present invention will now be described, by way of example, with reference to the accompanying drawings, in which.

DESCRIPTION OF PREFERRED EMBODIMENTS

Figure 1:
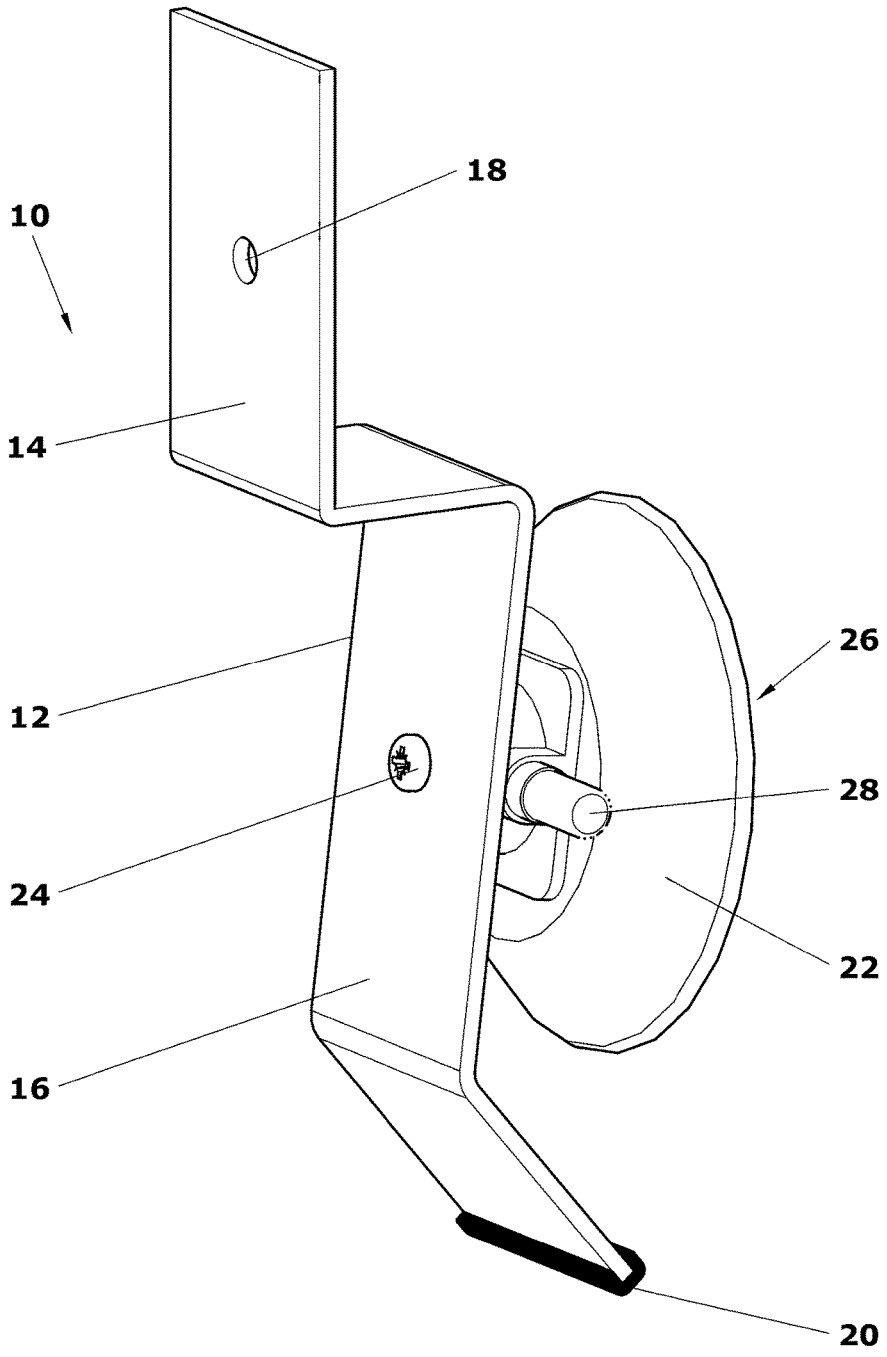
FIG. 1 is a perspective view of a bracket 10 according to the present invention.

Referring to FIG. 1, there is shown a bracket 10 having a rigid elongate spine 12, comprising an upper portion 14 configured as a right angle, and a lower portion 16, configured as an obtuse angle, within the spine 12. It is preferred that the spine 12 is constructed of galvanised steel. Within the upper portion 14 of the spine 12 is disposed an aperture 18, which allows a screw or bolt, etc. to pass through the spine 12. The spine 12 is further provided with a cushion 20 at its lower terminal end. In accordance with a preferred embodiment, the cushion 20 spans the entire width of the spine 12 and wraps from a from face to a rear face of the spine 12 over the lower terminal end of the spine 12. The cushion 20 is constructed of a resiliently deformable material, preferably rubber, so as to protect a surface that the spine 12 may come into contact with.

On the face of the spine on which the inner corners of the upper 14 and lower 16 portion angles are faced, proximal to the midpoint of the spine 12, is disposed a means for temporarily mounting the bracket upon a surface, exemplified by a suction cup 22. The suction cup 22 is in secure connection with the spine 12, through the use of a screw 24, for example. The concave suction face 26 of the cup 22 laces away from the spine 12. In the embodiment represented in FIG. 1, the suction sup 22 comprises an operating mechanism 28 which works to, when depressed, create a vacuum between the suction face 26 of the suction cup 22 and another surface, to engage the suction capability. When released, the operating mechanism 28 releases the suction cup 22 from the surface with which it was engaged.

Figure 2:
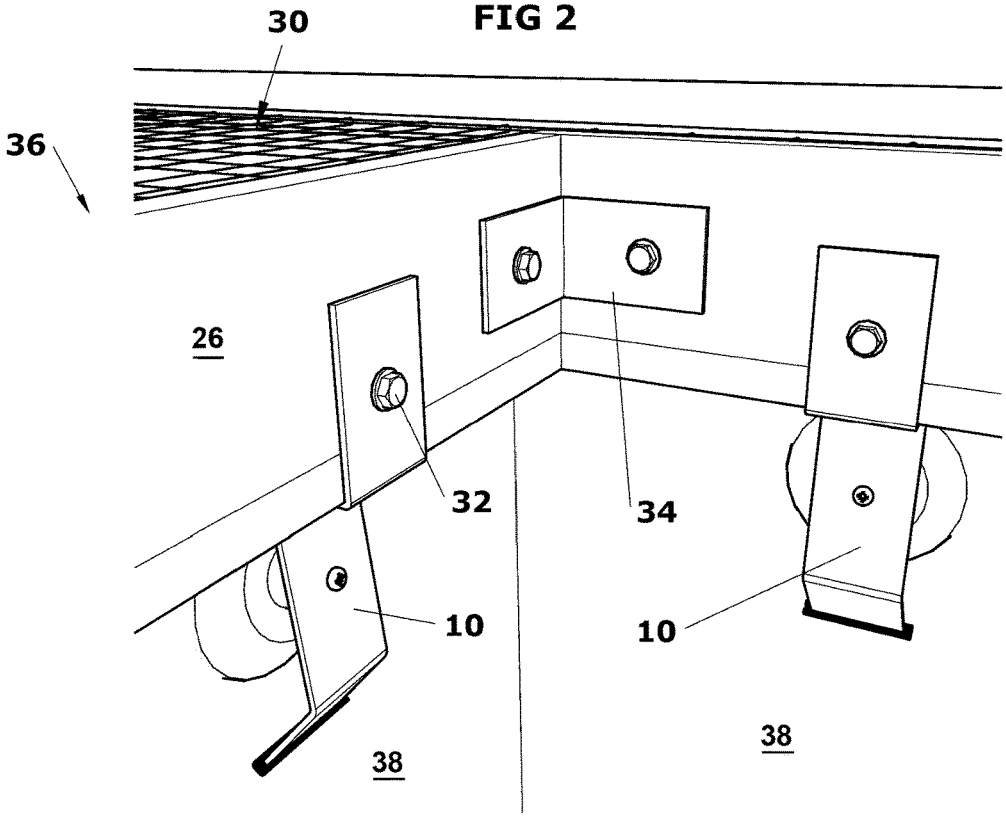
FIG. 2 is a perspective view of the brackets of FIG. 1 in use according to the present invention.
Figure 3:
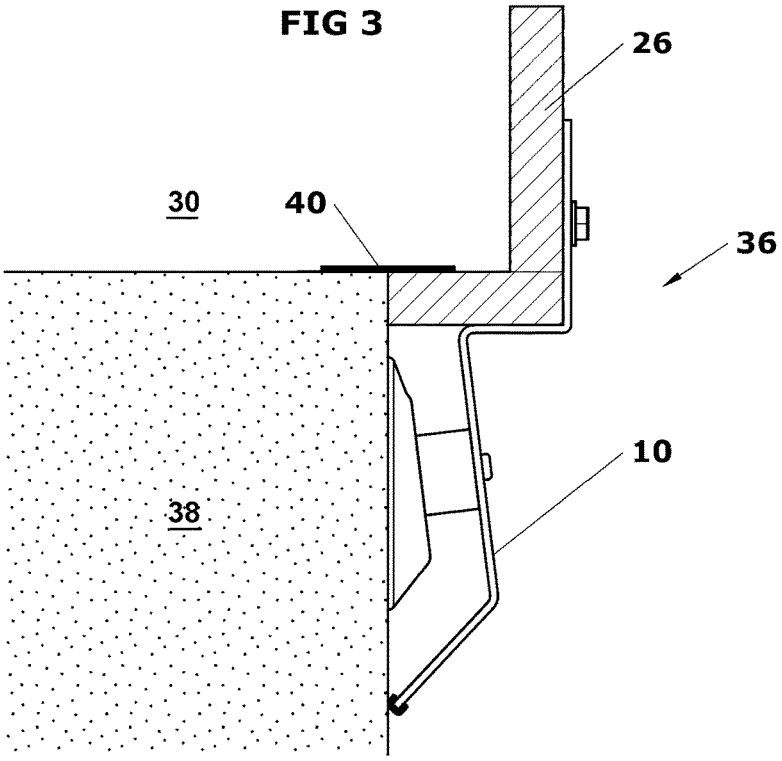
FIG. 3 is a cross-sectional view of one of the brackets of FIG. 2 in use according to the present invention.

With reference to FIG. 2, the moulding system 36 of the present invention, using the brackets 10, is shown. The system 36 comprises the use of the brackets 10 supporting formwork 26 over a pool 38 to create a box 30 into which concrete may be poured. The formwork 26, preferably comprising a plurality of elongate wooden pieces, is securely fixed to the bracket 10, preferably using a bolt 32, which is passed through the aperture 18 in the spine 12 and into the formwork 26. Additional supports 34 may be provided on the formwork 26, for example to lend strength to two adjoining pieces of formwork 26 forming a corner of the box 30.

In use, the system 36 of the present invention is employed when a continuous landscape, including coping, is desired around an edge, for example the edge of a pool 38. Initially, it may be desirable to lower the water level of the pool 38 somewhat, so that a greater height of pool 38 wall is exposed. Suitable locations on the pool 38, approximately one meter apart, are chosen for the brackets 10 to be placed. Using precise levelling techniques, preferably a laser level, the brackets 10 are installed on the exposed pool 38 wall.

The brackets 10 would be positioned according to the preferences of the user, but usually such that the horizontal part of the upper portion 14 of the spine 12 is lower than the level of a lip of the pool 38. Accordingly, when formwork 26 is placed onto the bracket 10, the top of the formwork 26 floor is substantially level with the pool 38 lip. An optional sealant 40, for example, adhesive tape, may be used between the formwork 26 and pool 38.

To install, the lace 26 of the suction cup 22 is contacted to the pool 38. The operating mechanism 28 on the suction cup 22 is depressed causing the suction cup 22 to securely engage with the pool 38. The suction cup 22 is so oriented that the spine 12 is substantially vertical, with the upper portion 14 above the lower portion 16.

Once all brackets 10 are securely positioned, the formwork 26 is installed. Firstly, a piece of formwork 26 is suspended from one or mote brackets 10 upon the horizontal part of the upper portion 14 of the spine 12. An inner edge of the formwork 26 is flush with the pool 38 wall such that no material is allowed to pass between the formwork 26 and the pool 38. As above, sealant 40 may be used to further prevent unwanted material from passing between the formwork 26 and pool 38. A further piece of formwork 26 is aligned with the vertical part of the upper portion 14 of the spine 12. This further piece of formwork 26 rests upon the first piece such that no material is allowed to pass between the two pieces of formwork 26. Additional formwork 26 pieces are installed in a similar fashion to the first two until the pool 38 is surrounded. As required, the formwork 26 is secured and tightened to the brackets 10 and therefore pool 38 using bolts 32 through the aperture 18 in the bracket 10 in a normal manner.

The formwork 26 continues away from the pool 38 edge until a complete box 30 is formed. Where needed, for example, to lend strength to two adjoining pieces of formwork 26 forming a corner of the box 30, additional supports 34 are tightened onto the formwork 26 using a suitable fixing means, including but not limited to bolts.

Once the box 30 is complete, sellable material, such as concrete, is poured into the box in a known manner. The material is leveled and allowed to set as would be understood by the skilled person. At a desired time, for example after setting of the material, the box 30 is dismantled and formwork 26 removed. To enable removal, the brackets 10 and supports 34 are loosened by unfixing the fixing means such as bolts 32 from the formwork 26. Finally, the brackets 10 are removed from the pool 38 by utilisation of the operating mechanism 28 outwards to release the suction cup 22 from the pool 38. What remains is continuous coping from an overhanging edge over the pool 38 outwards from the pool.

Other embodiment brackets 10 are also contemplated in accordance with the present invention. For instance, the aforementioned cushion 20 may, instead of being provided as wrapped from front to rear, be any shape and profile suited to the relevant function of proving protection between the bracket 10 and a surface within which it comes into contact. For example, the cushion 20 may be provided as a disc shape on the face of the spine that would contact the pool 38 surface. Likewise, the moulding system 36, instead of being used to landscape over and around a swimming pool 38, may be used to provide moulding over an edge of any desired structure. Further, the bracket 10 and moulding system 36 may be used to provide moulding over an edge of a round pool 38 or other structure. Accordingly, the formwork 26 may be constructed of polyurethane, MDF or any other material as is suitable, which is capable of some flexibility, allowing the moulding system 36 to be used on a curved shape.

Modifications and variations as would be apparent to a skilled addressee are deemed to be within the scope of the present invention.

The invention claimed is:

1. A bracket for creating continuous coping of a poured settable material beyond the edge of a structure, comprising:

a spine with an upper portion for supporting a piece of formwork; and a means for temporarily mounting the bracket upon a surface, wherein the means for temporarily mounting the bracket comprises a suction cup.

2. A bracket according to claim 1, wherein the suction cup comprises an operating mechanism for releasably creating a vacuum between the suction cup and another surface.

3. A bracket according to claim 1, wherein the spine further comprises a lower portion upon which the means for temporarily mounting the bracket is disposed.

4. A bracket according to claim 1, further comprising a cushion at a lower terminal end of the spine for protecting a surface within which the spine comes into contact.

5. A bracket according to claim 1, wherein the upper portion of the spine is configured as a substantial right angle within the spine.

6. A bracket according to claim 3, wherein the lower portion of the spine is configured as an obtuse angle within the spine.

7. A bracket according to claim 1, wherein the spine further comprises an aperture for allowing passage of a fixing means through the spine.

8. A method of creating continuous coping of a poured settable material beyond the edge of a structure, comprising the use of a bracket to support formwork creating a box into which the material is filled, wherein said bracket comprises a means for temporarily mounting the bracket upon a surface, wherein the means for temporarily mounting the bracket comprises a suction cup.

9. A method according to claim 8, wherein the continuous coping is created beyond the edge of a pool.

10. A method according to claim 8, wherein the continuous coping is created beyond the edge of a curved structure.

* * * * *

UNITED STATES PATENT AND TRADEMARK OFFICE

CERTIFICATE OF CORRECTION

PATENT NO. : 10,385,580 B2
APPLICATION NO. : 15/761076
DATED : August 20, 2019
INVENTOR(S) : Foley It is certified that error appears in the above-identified patent and that said Letters Patent is hereby corrected as shown below:

In the Specification

Column 2, Line 39, after "wraps from a" delete "from" and insert --front-- therefor.

Column 2, Line 51, after "cup 22" delete "laces" and insert --faces-- therefor.

Column 3, Line 21, after "To install, the" delete "lace" and insert --face-- therefor.

Column 3, Line 29, after "from one or" delete "mote" and insert --more-- therefor.

Signed and Sealed this
First Day of October, 2019

Andrei Iancu

Andrei Iancu
*Director of the United States Patent and Trademark Office*